United States Patent [19]

Prunty, II et al.

[11] Patent Number: 4,716,953

[45] Date of Patent: Jan. 5, 1988

[54] VENT PLUG

[75] Inventors: John E. Prunty, II, Des Moines, Iowa; Jeffrey D. Eagens, Rocky River, Ohio

[73] Assignee: Burnswick Industrial Supply Co., Lakewood, Ohio

[21] Appl. No.: 862,763

[22] Filed: May 13, 1986

[51] Int. Cl.[4] ..... B22C 15/22; B22C 23/00

[52] U.S. Cl. ..... 164/200; 164/234; 164/410

[58] Field of Search ..... 164/410, 234, 200–202; 425/812

[56] References Cited

U.S. PATENT DOCUMENTS 3,188,701 6/1965 McIntyre ..... 164/410
3,214,803 11/1965 Arnt ..... 164/410
3,529,656 9/1970 Levy ..... 164/410 X
4,083,665 4/1978 Schnellmann et al. ..... 425/812 X

FOREIGN PATENT DOCUMENTS 45-5896 2/1970 Japan ..... 425/812
922788 4/1963 United Kingdom ..... 425/812

*Primary Examiner*—Nicholas P. Godici
*Assistant Examiner*—J. Reed Batten, Jr.
*Attorney, Agent, or Firm*—Fay, Sharpe, Beall, Fagan, Minnich & McKee

[57] ABSTRACT

A vent plug used in a chamber for manufacturing sand molds by a blow-squeeze process is configured to provide turbulent swirling flow of air vented from the chamber past the vent plugs to minimize build-up of deposits on the surfaces of the vents and vent plugs.

33 Claims, 6 Drawing Figures

FIG. 1
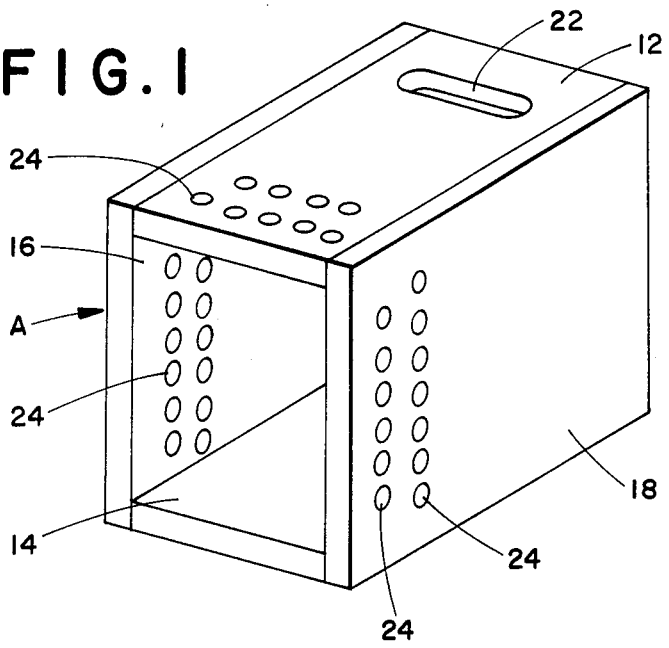
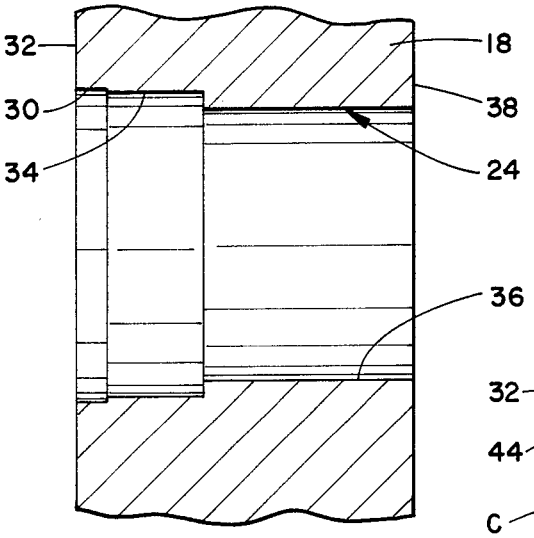
FIG. 2
FIG. 3
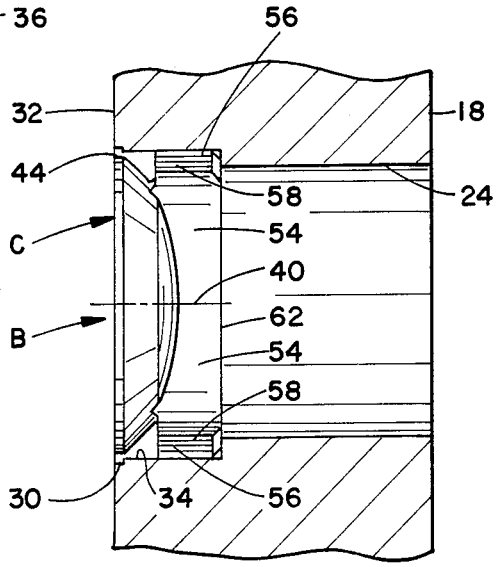

VENT PLUG

BACKGROUND OF THE INVENTION

This invention relates to the art of venting and, more particularly, to venting of air from a chamber through holes which are restricted by vent plugs. Although the invention is particularly applicable for use in chambers for manufacturing sand molds by a blow-squeeze process and will be described with specific reference thereto, it will be appreciated that the invention has broader aspects, and may be used in other environments for other purposes.

Sand molds are commonly manufactured by blowing sand onto a pattern located within a chamber from which the air is vented in a controlled manner for properly distributing and packing the sand in the pattern. The location and number of vent openings achieve proper or predetermined distribution of the sand. The vents are defined by holes or passages extending through the walls of the chamber which, in turn, are restricted by vent plugs. The outlet vent passages thus defined are dimensioned to be smaller than the sand particle size so that substantially all of the sand will remain in the chamber.

However, and notwithstanding the foregoing dimensional relationships, there is a considerable amount of dust or sand fines which pass through the restricted vent passages and build up on the passage walls. The build-up of these deposits restricts the vent passages to such an extent that the sand will not be properly distributed throughout the pattern, and the sand mold thereafter produced may have insufficient density due to excessive entrained air. Therefore, frequent removal of the vent plugs and cleaning of the vent passages is necessary for production of satisfactory sand molds.

It has been considered desirable to develop a vent plug arrangement that would minimize build-up of deposits on the walls of the vent passages. The subject invention is believed to meet these needs and others in providing a vent plug having a new and novel conformation.

SUMMARY OF THE INVENTION

According to the subject invention, vent plugs of the type described are configured for providing turbulent swirling flow of air through the vent passages to thereby minimize build-up of deposits on the walls of such passages.

In a preferred arrangement, the improved vent plug of the present invention includes a substantially circular head having a central axis, a substantially flat front face, an outer peripheral surface, and a rear portion. The outer peripheral surface of the head is substantially cylindrical and extends parallel to the central axis.

In accordance with one aspect of the invention, the rear portion of the vent plug includes sloping rear surface means which slopes toward the central axis in a direction away from the front face. This advantageous arrangement changes the direction of air flow as it moves past the outer peripheral surface of the head so that the air flow is directed inwardly toward the central axis and its velocity substantially increased. The change in direction and increased velocity help to minimize build-up of deposits and also help to produce a turbulent swirling motion of the air in a vortex-type of motion. This directs the air flow through the center of the vent hole so that dust particles entrained in the air stream do not contact the walls of the vent holes. The vortex-type of flow also scours the walls of the passages and produces a vacuum for positively exhausting air from the chamber.

In accordance with an important aspect of the invention, the sloping rear surface means includes intersecting inner and outer rear surface areas which slope at different angles relative to the central axis, and intersect one another at an included angle substantially greater than 90° and less than 180°. The inner rear surface area preferably slopes at a substantially greater angle than the outer rear surface area. In one arrangement, the outer rear surface area slopes at an angle of approximately 40°–50° relative to the central axis, while the inner rear surface area slopes at an angle of approximately 10°–20° with respect to the central axis.

In accordance with another aspect of the invention, the outer rear surface area has a width measured parallel to the central axis which is substantially greater than the width of the inner rear surface area. Also, the width of the peripheral surface of the head is preferably substantially less than the width of the outer rear surface area.

According to yet another aspect of the invention, the rear portion of the vent plug includes mounting means for mounting same in a vent hole while providing air flow past the outer peripheral surface of the head. The mounting means divides the inner rear surface area into a plurality of individual segment areas. The mounting means may take the form of a spider having a plurality of spokes extending generally radially of the central axis and terminating at outer spoke ends which lie on the periphery of a circle having a diameter greater than the circular head. The sidewalls of the spokes intersect at smoothly curved juncture portions such that each individual segment area of the inner rear surface area is bounded by a generally U-shaped periphery. The generally U-shaped periphery lies on the periphery of a circle whose center is located inwardly of the outer peripheral surface of the circular head. The length of the generally U-shaped periphery is less than one-half the circumference of the circle on which it lies.

The principal advantage of the present invention is the provision of an improved vent plug which minimizes build-up of deposits on the surfaces of vent passages.

Another advantage of the invention resides in an improved vent plug which provides turbulent swirling flow of air in a generally vortex-type of motion which scours the surfaces of the vent passages and positively draws air from a chamber being vented.

Yet another advantage of the invention is found in an improved vent plug which is economical to manufacture and install.

Still other advantages and benefits of the subject invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 1 is a diagrammatic perspective illustration of a chamber in which sand molds are manufactured by a blow-squeeze process;

FIG. 2 is a cross-sectional elevational view of a vent hole through a plate and the chamber of FIG. 1;

FIG. 3 is a view similar to FIG. 2 with a vent plug formed in accordance with the present invention installed in the vent hole and with the upper spider leg rotated slightly for ease of showing the installed condition;

DESCRIPTION OF A PREFERRED EMBODIMENT

Figure 4:
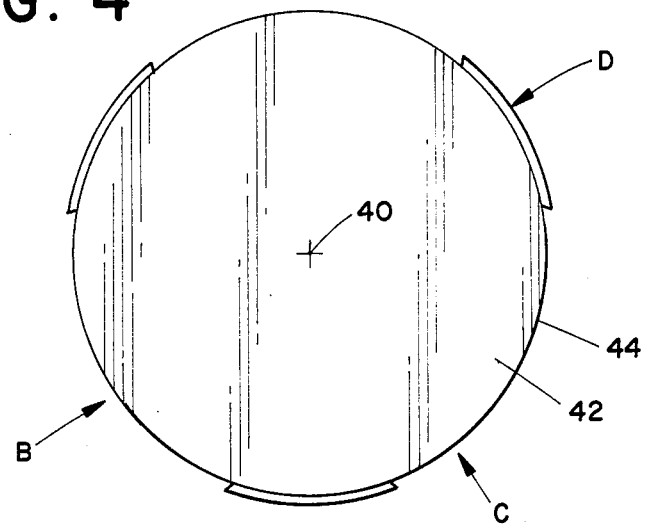
FIG. 4 is a front elevational view of a vent plug constructed in accordance with the present invention.

Referring now to the drawings wherein the showings are for purposes of illustrating a preferred embodiment of the invention only and not for purposes of limiting same, FIG. 1 shows a generally rectangular chamber A comprised of top and bottom plates 12, 14, and opposite side plates 16, 18. During manufacture of a sand mold, the front of chamber A is closed by a movable door (not shown) while the rear of the chamber is closed by a movable ram (not shown). Typically, the inner or opposing faces of the door and ram include pattern portions thereon as is known. Sand and air are blown into chamber A through an inlet opening 22 in top plate 12 for depositing the sand therein. Filling of the pattern with sand may take one-six seconds, and the ram is then moved toward the door for squeezing the sand to form a mold half. The pattern portions on the door and ram generate the desired cavities on opposite sides of the mold as is also known in the art. Each mold half is cooperable with the next adjacent mold halves. One apparatus of this general type is marketed by Disamatic Inc. of Hinsdale, Ill. under the trademark DISAMATIC. Since this apparatus is known in the art, a further detailed description thereof is deemed unnecessary to a full and complete understanding of the subject invention.

During the filling and squeezing steps, air is exhausted from chamber A through vent holes 24 which are distributed and located to achieve proper distribution of the sand throughout the chamber. Vent holes 24 are restricted by vent plugs having outlet openings smaller than the particle size of the sand being used so that most of the sand will remain within the chamber. However, dust and sand fines are exhausted through the vent passages where they build up to restrict proper venting flow of the air which results in molds of improper density or improper distribution of sand throughout the pattern.

In accordance with the present invention, a vent hole 24 in a side plate 18 is shown as a stepped hole which includes a large diameter bore 30 which intersects and opens outwardly at inner face 32 of plate 18 which faces inwardly of chamber A. An intermediate diameter bore 34 concentric with large diameter bore 30 extends inwardly from large diameter bore 30. A small diameter bore 36 concentric with intermediate bore 34 extends from intermediate diameter bore 34 to intersect outer face 38 of plate 18 and open outwardly thereat. The length of intermediate diameter bore 34 is substantially greater than the length of large diameter bore 30, and the length of small diameter bore 36 is substantially greater than the length of intermediate diameter bore 34. Large diameter bore 30 has a diameter of approximately 1.004 inches and a depth of approximately 0.10 inches. Intermediate diameter bore 34 has a diameter of approximately 0.995 inches and a depth of approximately 0.322 inches. Small diameter bore 36 has a diameter of approximately 0.875 inches.

Figure 6:
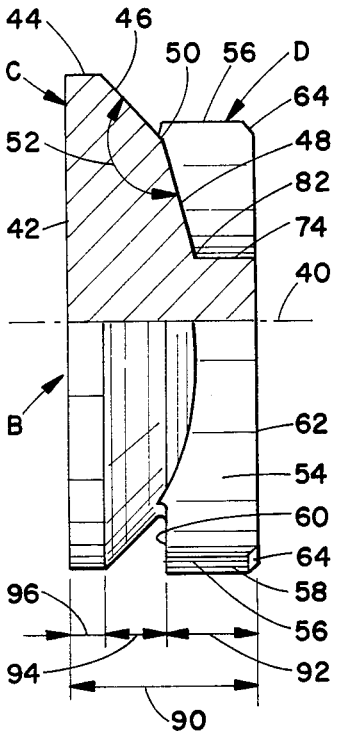
FIG. 6 is a partial cross-sectional elevational view and a partial side elevational view taken generally along lines 6—6 of FIG. 5.
Figure 5:
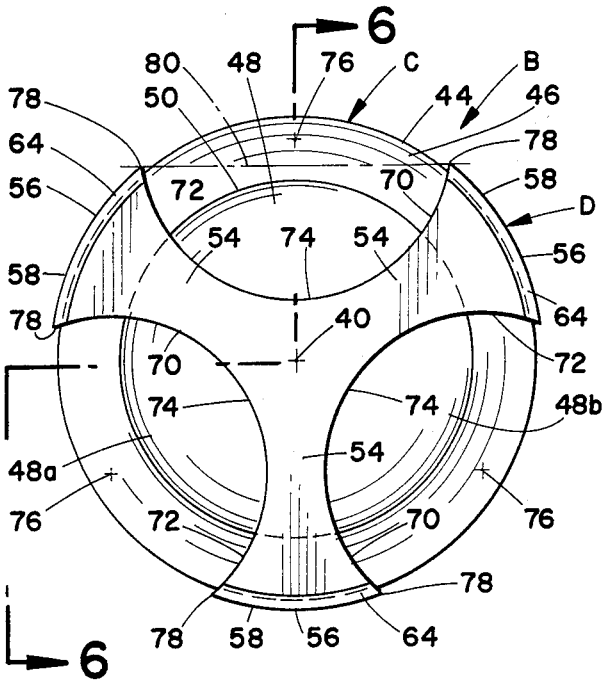
FIG. 5 is a rear elevational view of the vent plug of FIG. 4.

Improved vent plug B of the present invention as shown in FIGS. 4–6 includes a substantially circular head C having a central axis 40, a substantially flat outer face 42, a substantially cylindrical outer peripheral surface 44 extending substantially parallel to central axis 40, and a rear portion which will be described hereafter.

The rear portion of vent plug B includes mounting means D for mounting the plug B in a vent hole while providing air flow past outer peripheral surface 44. The rear portion of vent plug B also includes sloping rear surface means which slopes toward central axis 40 in a direction away from flat front face 42. In the arrangement shown, the rear surface means is defined by intersecting outer and inner rear surface areas 46, 48 which intersect one another at an intersection line 50 and at an included angle 52 which is substantially greater than 90° and less than 180°.

Intersection line 50 between outer and inner rear surface areas 46, 48 is located substantially less than one-half the radial distance from outer peripheral surface 44 to central axis 40. When widths are described, it is to be appreciated that what is meant is widths as measured parallel to central axis 40. To that end, the width of outer rear surface area 46 is substantially greater than the width of inner rear surface area 48 and is also substantially greater than the width of outer peripheral surface 44.

Outer rear surface area 46 intersects the rear edge of outer peripheral surface 44 and slopes at an included angle with central axis 40 of approximately 40°–50°, with 45° being the optimum. Inner rear surface area 48 is inclined at an included angle with central axis 40 of approximately 70°–80°, with approximately 75° being the optimum. Thus, included angle 52 between outer and inner rear surface areas 46, 48 is approximately 140°–160°, with approximately 150° being the optimum. It will be seen that the slope of inner rear surface area 48 is substantially greater than the slope of outer rear surface area 46 and that the length of inner rear surface area 48 is also substantially greater than the length of outer rear surface area 46.

Mounting means D comprises a spider having a plurality of spokes 54 circumferentially spaced equidistantly from one another and extending generally radially of central axis 40. Spokes 54 terminate at outer spoke terminal end 56 which lie on the periphery of a circle having a diameter greater than the diameter of circular head C. Spoke terminal ends 56 are longitudinally grooved as generally indicated at 58 to provide teeth thereon extending substantially parallel to central axis 40. Thus, the teeth will, in effect, bite into the peripheral wall of intermediate diameter bore 34 of FIG. 2 when vent plug B is mounted therein as shown in FIG. 3.

As shown in FIG. 5, spokes 54 divide the inner rear surface area into a plurality of individual inner rear surface segment areas 48, 48*a* and 48*b*. However, as shown in FIG. 6, spokes 54 extend outwardly beyond outer rear surface area 46 so that outer rear surface area 46 is circumferentially continuous while the inner rear surface area is circumferentially interrupted by the spokes of the mounting means. As shown in FIG. 6, spokes 54 have flat surfaces 60 which extend substantially perpendicular to central axis 40 in facing relationship to outer rear surface area 46. The spider defined by mounting means D has a substantially flat rear face 62 extending substantially perpendicular to central axis 40. The intersections between spoke terminal ends 56 and spider rear faces 62 are chamfered at 45° angles as indicated at 64.

Referring again to FIG. 5, spokes 54 have opposite side surfaces 70, 72 which extend parallel to central axis 40 and substantially perpendicular to rear face 62 of spider D. Side surfaces 70, 72 of adjacent spokes 54 intersect or merge at smoothly curved juncture portions 74 whose surfaces also extend substantially perpendicular to spider rear face 62. Side surfaces 70, 72 and juncture portions 74 between adjacent spokes 54 define a generally U-shaped periphery or configuration. Each U-shaped periphery is curved to lie on the periphery of a circle whose center 76 is located inwardly from outer peripheral surface 44. Each U-shaped periphery intersects terminal spoke ends 56 at intersections 78. The width of each generally U-shaped periphery across intersections 78 as measured along line 80 in FIG. 5 is less than the depth of the generally U-shaped periphery as measured from line 80 to the center of the base thereof. The total length of each U-shaped periphery along its curved path between adjacent intersections 78 is less than one-half the circumference of the circle on which it lies. Each U-shaped periphery intersects a segment area 48, 48*a*, 48*b* at a generally U-shaped intersecting line.

As shown in FIG. 6, inner rear segment area 48 intersects smoothly curved juncture portions 74 at an intersecting line 82. The width of juncture portions 74 as measured parallel to central axis 40 is substantially greater than the width of inner rear surface portion 48. Each generally U-shaped periphery between adjacent spokes as described includes opposite legs and a base portion. The width of spider D at this base portion as indicated at 74 in FIG. 6 is substantially greater than one-half the width of spider D at terminal spoke ends 56 thereof. The generally U-shaped intersecting line between each inner rear surface segment area 48, 48*a*, 48*b* with spider D lies in a plane which intersects central axis 40 at an included angle substantially less than 90°.

With a vent plug of the type described, air flows past outer peripheral surface 44 and is then directed inwardly generally along inclined outer and inner surface areas 46, 48. This creates a tremendous increase in velocity. Also, the changing directions of air flow create turbulent swirling flow in a vortex-type of motion so that a plurality of individual turbulent and swirling air flows leave spider D along juncture portions 74 inwardly of the peripheral surface of small diameter bore 36. Thus, particles are carried along in these individual turbulent air streams instead of engaging the walls of the vent hole. The many changes in direction of the air flowing past outer peripheral surface 44 scour the surfaces of vent plug B to minimize build-up of deposits thereon and minimize any dead air spaces.

In a typical vent plug sized for use with the hole of FIG. 2, head C has a diameter of approximately 0.974 inches while the diameter of the circle on which spoke ends 56 lies is approximately 1.004 inches. The circles on which the U-shaped peripheral portions are formed in FIG. 5 have a radius of approximately 0.313 inch and centers 76 lie approximately 0.875 inches from central axis 40.

For the size of the hole mentioned in FIG. 2, reference is had to FIG. 6 for a plurality of width dimensions for vent plug B. Dimension 90 is approximately 0.383 inch. Dimension 92 is approximately 0.188 inch. Dimension 94 is approximately 0.125 inch. Dimension 96 is approximately 0.07 inch as manufactured. However, when plug B is installed in a vent hole, the inner surface of the plate and outer faces 42 of the vent plugs are machined smooth so that when a plate with plugs installed is ready for use, dimension 96 of outer peripheral surface 44 is approximately 0.010 inches–0.030 inches with the optimum being approximately 0.019 inches. Thus, the final size of dimension 90 is approximately 0.323–0.343 inch with the optimum being approximately 0.332 inch.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus defined the invention, it is now claimed:

1. A vent plug comprising:
   - a substantially circular head having a central axis, a substantially flat front face, an outer peripheral surface and a rear portion;
   - said rear portion including mounting means for mounting said vent plug in a vent hole while providing air flow past said outer peripheral surface; and,
   - said rear portion including sloping rear surface means which slopes toward said axis in a direction away from said front face.

2. The vent plug as defined in claim 1 wherein said outer peripheral surface in substantially cylindrical.

3. The vent plug as defined in claim 1 wherein said sloping rear surface means includes intersecting inner and outer rear surface areas which slope at different angles.

4. The vent plug as defined in claim 3 wherein said inner rear surface area slopes at a substantially steeper angle than said outer rear surface area.

5. The vent plug as defined in claim 4 wherein said outer rear surface area intersects said outer peripheral surface.

6. The vent plug as defined in claim 3 wherein said outer rear surface area is circumferentially continuous and said inner rear surface area is circumferentially interrupted by said mounting means and is thereby divided into a plurality of individual segment areas.

7. The vent plug as defined in claim 3 wherein the width of said outer rear surface area as measured parallel to said axis is substantially greater than the width of said inner rear surface area as measured parallel to said axis.

8. The vent plug as defined in claim 7 wherein the axial width of said outer peripheral surface as measured parallel to said axis is substantially smaller than said width of said outer rear surface area.

9. The vent plug as defined in claim 3 wherein said outer rear surface area slopes at an included angle with said axis of approximately 40°–50°, and said inner rear surface area slopes at an included angle with said axis of approximately 70°–80°.

10. The vent plug as defined in claim 1 wherein said mounting means includes a plurality of arcuate surfaces which extend substantially parallel to said axis and intersect said rear surface means.

11. The vent plug as defined in claim 1 wherein said mounting means has a width measured parallel to said axis which is not greater than the sum of the widths of said peripheral surface plus the width of said rear surface means measured parallel to said axis.

12. The vent plug as defined in claim 1 wherein said mounting means comprises a spider having a plurality of spokes extending generally radially of said axis and circumferentially spaced substantially equidistantly from one another, said spokes having outer terminal spoke ends lying on the periphery of a circle of a diameter greater than the diameter of said head, said spider having a rear face, said sloping rear surface means including a plurality of individual surface areas between adjacent spokes of said spider, each said individual surface area intersecting said spider spaced inwardly of said rear face along a substantially U-shaped intersection line which lies in a plane intersecting said axis at an included angle less than 90°.

13. The vent plug as defined in claim 12 wherein each said U-shaped intersection line includes a base portion and opposite legs extending therefrom, the width of said spider at the center of said base portion as measured parallel to said axis being at least one-half the width of said spokes at the outer ends thereof as measured parallel to said axis.

14. The vent plug as defined in claim 1 wherein said sloping rear surface means includes sloping inner and outer rear surface areas which intersect one another at an included angle substantially greater than 90° and less than 180°.

15. The vent plug as defined in claim 14 wherein said outer peripheral surface of said head is substantially cylindrical.

16. The vent plug as defined in claim 14 wherein said inner and outer surface areas intersect one another at locations substantially less than half of the radial distance from said outer peripheral surface of said head to said axis.

17. The vent plug as defined in claim 14 wherein said inner and outer surface areas intersect one another along an intersecting line located on the periphery of a circle, and said intersecting line being interrupted by said mounting means.

18. The vent plug as defined in claim 1 wherein said mounting means comprises a spider having a rear face whose area is substantially less than the area of said sloping rear surface means.

19. The vent plug as defined in claim 1 wherein said mounting means comprises a spider having a plurality of circumferentially spaced spokes with spoke terminal ends, said spokes having side surfaces and adjacent spokes intersecting at smoothly curved juncture portions, said side surfaces of adjacent spokes together with said smoothly curved juncture portions defining a generally U-shaped configuration having a width as measured across the intersections of said spoke side surfaces with said spoke terminal ends which is less than two times the depth thereof.

20. The vent plug as defined in claim 1 wherein said mounting means comprises a spider having a plurality of circumferentially spaced spokes extending generally radially of said axis, adjacent spokes having sidewalls and juncture portions defining a generally U-shaped periphery between adjacent spokes, each said U-shaped periphery lying on the periphery of a circle having a center located inwardly toward said axis from said outer peripheral surface.

21. The vent plug as defined in claim 20 wherein the length of said generally U-shaped periphery is less than one-half the circumference of the circle on which it lies.

22. A vent plug comprising:

a substantially circular head having a central axis, a substantially flat front face, an outer peripheral surface, and a rear surface opposite from said front face;

mounting means for mounting said vent plug in a hole while providing air flow past said peripheral surface;

said peripheral surface being substantially cylindrical and intersecting said rear surface at a rear edge; and, said rear surface sloping from said rear edge toward said axis at an included angle with said axis of substantially less than 90°.

23. The vent plug as defined in claim 22 wherein said rear surface includes inner and outer rear surface areas intersecting one another at an included angle substantially greater than 90° and less than 180°.

24. The vent plug as defined in claim 23 wherein said outer rear surface area is circumferentially continuous and said inner surface area is circumferentially interrupted by said mounting means.

25. The vent plug as defined in claim 23 wherein the intersection between said inner and outer surface areas is located substantially less than one-half the radial distance from said outer peripheral surface to said axis.

26. The vent plug as defined in claim 23 wherein said mounting means divides said inner rear surface area into a plurality of individual segment areas by mounting means sidewalls which converge toward said axis and extend substantially parallel to said axis.

27. The vent plug as defined in claim 26 wherein said mounting means sidewalls merge at smoothly curved juncture portions which extend substantially parallel to said axis.

28. A vent plug comprising:

a substantially circular head having a central axis, a substantially flat front face, an outer peripheral surface, and a rear surface opposite from said front face;

a spider on said rear surface having a plurality of spaced-apart spokes which terminate at spoke terminal ends lying on the periphery of a circle having a diameter greater than the diameter of said head, said spider having a rear face which faces outwardly in a direction generally opposite from the facing direction of said front face;

adjacent spokes of said spider being spaced apart by generally U-shaped spaces whose periphery is defined by side surfaces of said spokes and by curved spoke juncture portions at the inner end portions of said spokes;

said rear surface of said head being sloped from said outer peripheral surface of said head toward said central axis in a direction from said outer peripheral surface of said head toward said rear face of said spider; and, said rear surface of said head intersecting said juncture portions of said spokes along intersection lines which are axially spaced from said rear face of said spider.

29. The vent plug as defined in claim 28 wherein said outer peripheral surface of said head is substantially cylindrical and has a width measured parallel to said axis which is less than the width of said rear surface measured parallel to said axis.

30. The vent plug as defined in claim 29 wherein said rear surface includes inner and outer rear surface areas intersecting at an included angle substantially greater than 90° and less than 180°.

31. The vent plug as defined in claim 30 wherein the slope of said inner rear surface area is substantially greater than the slope of said outer rear surface area.

32. The vent plug as defined in claim 31 wherein the intersection between said inner and outer rear surface areas is located substantially less than one-half the radial distance from said outer peripheral surface to said axis.

33. A plate for a chamber in which sand molds are blown, a stepped circular hole through said plate and including a large diameter bore intersecting an inner face of said plate, an intermediate diameter bore extending concentrically from said large diameter bore, and a small diameter bore extending concentrically from said intermediate diameter bore and intersecting an outer face of said plate, a vent plug having mounting means mounted in said intermediate diameter bore, and said vent plug including a substantially circular head which is smaller in diameter than said large diameter bore, an outer peripheral surface, and a rear portion including said mounting means, and said vent plug being mounted by said mounting means so the outer peripheral surface of said head is spaced radially inward from said large diameter bore for allowing air flow pass said outer peripheral surface.

* * * * *